US007611025B2

(12) United States Patent
Nusbaum et al.

(10) Patent No.: US 7,611,025 B2
(45) Date of Patent: Nov. 3, 2009

(54) CLOSURE DEVICE COMPRISING A HINGED CAP MOULDED IN THE CLOSED POSITION

(75) Inventors: Philippe Nusbaum, Daix (FR); Yannick Celerier, Aluze (FR); Jeremy Le Cam, Dijon (FR)

(73) Assignee: Bericap, Longvic (FR)

( * ) Notice: Subject to any disclaimer, the term of this patent is extended or adjusted under 35 U.S.C. 154(b) by 444 days.

(21) Appl. No.: 11/032,292

(22) Filed: Jan. 10, 2005

(65) Prior Publication Data

US 2005/0173368 A1 Aug. 11, 2005

Related U.S. Application Data

(63) Continuation of application No. PCT/FR03/02061, filed on Jul. 2, 2003.

(51) Int. Cl.
*B65D 43/16* (2006.01)
*B65D 41/32* (2006.01)

(52) U.S. Cl. ..... 215/253; 215/235; 222/556; 220/254.3

(58) Field of Classification Search ..... 215/235, 215/237, 253, 252; 222/556; 220/254.3, 220/254.5

See application file for complete search history.

(56) References Cited

U.S. PATENT DOCUMENTS

| | | | |
|---|---|---|---|
| 2,162,752 | A | 6/1939 | Schauer |
| 2,162,754 | A | 6/1939 | Schauer |
| 2,361,464 | A | 10/1944 | Edwards et al. |
| 2,961,119 | A | 11/1960 | Leach |
| 3,117,701 | A | 1/1964 | Stull |
| D226,555 | S | 3/1973 | Weber |
| 3,823,841 | A | 7/1974 | Lovejoy |
| 3,920,141 | A | 11/1975 | Bojardi |

(Continued)

FOREIGN PATENT DOCUMENTS

| | | | |
|---|---|---|---|
| DE | 197 08 909 | A1 | 9/1998 |

(Continued)

OTHER PUBLICATIONS

International Search Report for PCT/FRO3/02061, dated Nov. 27, 2003, 7 sheets.

(Continued)

*Primary Examiner*—Anthony D Stashick
*Assistant Examiner*—James N Smalley
(74) *Attorney, Agent, or Firm*—Harness, Dickey & Pierce, P.L.C.

(57) ABSTRACT

The invention concerns a closure comprising a base portion and a cap forming portion including a top articulated to a ring through a hinge. The strap enables the cap forming portion to be moulded in closing position of the top, tamperproof means being provided between the ring and the top. When the cover is closed, the sensitive zones of the cap are either located in a sealed closed space, or capable of being in contact with a liquid (in solution or spray) and capable of being treated so as to eliminate said liquid, so as to sanitize the closure. Furthermore, the tamperproof means are deformed and ruptured when the top is first opened such that the resulting free ends are sufficiently spaced apart from each other, thus easily revealing to a user whether it has been tampered with.

24 Claims, 8 Drawing Sheets

U.S. PATENT DOCUMENTS

| | | | | | |
|---|---|---|---|---|---|
| 3,944,102 | A | | 3/1976 | Grau | |
| 4,371,089 | A | | 2/1983 | Barendregt | |
| 4,418,828 | A | | 12/1983 | Wilde et al. | |
| 4,457,438 | A | | 7/1984 | Varlet et al. | |
| 4,474,301 | A | | 10/1984 | Davis | |
| 4,487,324 | A | | 12/1984 | Ostrowsky | |
| 4,494,663 | A | | 1/1985 | Bertaud et al. | |
| D280,802 | S | | 10/1985 | Cho | |
| 4,565,294 | A | | 1/1986 | Smith | |
| 4,595,123 | A | | 6/1986 | Libit | |
| 4,598,833 | A | | 7/1986 | Herr | |
| 4,635,823 | A | | 1/1987 | Stull | |
| 4,709,823 | A | | 12/1987 | Beck et al. | |
| 4,711,363 | A | | 12/1987 | Marino | |
| 4,733,787 | A | | 3/1988 | Knopf et al. | |
| 4,795,044 | A | | 1/1989 | Beck | |
| 4,805,807 | A | | 2/1989 | Perne et al. | |
| 4,830,224 | A | | 5/1989 | Brison | |
| 4,874,101 | A | | 10/1989 | Zalut | |
| 4,909,404 | A | | 3/1990 | Rozenberg | |
| 4,984,699 | A | | 1/1991 | Zalut | |
| 5,005,718 | A | | 4/1991 | Buono | |
| 5,007,546 | A | | 4/1991 | Rose et al. | |
| 5,007,555 | A | | 4/1991 | Beck | |
| 5,046,629 | A | * | 9/1991 | Weile | 215/221 |
| 5,085,332 | A | | 2/1992 | Gettig et al. | |
| 5,090,581 | A | | 2/1992 | Rose et al. | |
| 5,090,788 | A | | 2/1992 | Ingram et al. | |
| 5,104,008 | A | | 4/1992 | Crisci | |
| 5,115,932 | A | | 5/1992 | Schneider | |
| 5,147,054 | A | | 9/1992 | Pehr | |
| 5,219,507 | A | | 6/1993 | Ingram et al. | |
| 5,335,802 | A | | 8/1994 | Brach et al. | |
| 5,395,015 | A | * | 3/1995 | Bolen et al. | 222/546 |
| 5,400,912 | A | * | 3/1995 | Brown et al. | 215/238 |
| 5,417,350 | A | | 5/1995 | Koo | |
| 5,605,240 | A | * | 2/1997 | Guglielmini | 215/256 |
| 5,648,037 | A | | 7/1997 | Franchet et al. | |
| 5,685,444 | A | * | 11/1997 | Valley | 215/253 |
| 5,725,115 | A | * | 3/1998 | Bosl et al. | 215/252 |
| 5,785,193 | A | | 7/1998 | Kobayashi et al. | |
| 5,799,840 | A | | 9/1998 | Mogard | |
| 5,810,185 | A | * | 9/1998 | Groesbeck | 215/387 |
| 5,846,471 | A | | 12/1998 | Thakor et al. | |
| 5,913,434 | A | | 6/1999 | Fukuhara et al. | |
| 5,934,496 | A | | 8/1999 | Mogard et al. | |
| 5,975,369 | A | * | 11/1999 | Yurkewicz et al. | 222/153.06 |
| 5,992,659 | A | | 11/1999 | Nofer et al. | |
| 6,050,434 | A | * | 4/2000 | McNab | 215/235 |
| 6,079,589 | A | * | 6/2000 | Matsuyama et al. | 220/715 |
| 6,116,477 | A | | 9/2000 | Kreiseder et al. | |
| 6,185,906 | B1 | | 2/2001 | Mogard et al. | |
| 6,223,918 | B1 | | 5/2001 | Browne | |
| D463,280 | S | | 9/2002 | Brozell | |
| 6,478,184 | B2 | | 11/2002 | Berge et al. | |
| D480,305 | S | | 10/2003 | Nusbaum et al. | |
| 6,817,276 | B1 | | 11/2004 | Kowal | |

FOREIGN PATENT DOCUMENTS

| | | |
|---|---|---|
| DE | 197 12 364 A1 | 10/1998 |
| DE | 197 34 874 | 2/1999 |
| EP | 0 529 383 A2 | 8/1992 |
| ES | 1 002 990 | 7/1987 |
| ES | 1002990 | 7/1988 |
| FR | 1303608 | 9/1962 |
| FR | 2309425 | 11/1976 |
| FR | 2 407 140 | 5/1979 |
| FR | 2558444 | 7/1985 |
| FR | 2 744 101 | 8/1997 |
| GB | 1140840 | 1/1969 |
| GB | 1522692 | 8/1978 |
| GB | 1530158 | 10/1978 |
| GB | 1 569 781 | 6/1980 |
| GB | 2200619 | 8/1988 |
| GB | 2 353 519 | 2/2001 |
| JP | 56 161954 | 12/1981 |
| WO | WO 92/17379 | 10/1992 |
| WO | WO 00/27722 | 5/2000 |
| WO | WO 00/76875 | 12/2000 |
| WO | WO 01/42103 | 6/2001 |
| WO | WO 01/54999 | 8/2001 |

OTHER PUBLICATIONS

French Search Report of French Publication No. 2842177, 1 page.
French Search Report of French Publication No. 2842176, 1 page.

* cited by examiner

CLOSURE DEVICE COMPRISING A HINGED CAP MOULDED IN THE CLOSED POSITION

CROSS-REFERENCE TO RELATED APPLICATIONS

This application is a continuation of Application No. PCT/FR2003/002061, filed Jul. 2, 2003, which claims priority to French Application Nos. 02 08849 and 02 08850, both of which were filed Jul. 12, 2002. All of these applications are incorporated by reference herein.

BACKGROUND AND SUMMARY OF THE INVENTION

The invention concerns a closure of the type comprising on the one hand a base part comprising a top opening and a bottom opening at its axial ends and intended to be mounted on the neck of a receptacle, and on the other hand a part forming a cap itself comprising an annular ring connected to the base part and a cover associated with the ring by a joining and hinging device, the cover being able to be moved, with respect to the ring, between an open position and a closed position.

The invention concerns more specifically such closures in which the shape and geometry of the joining and hinging device are suitable for allowing moulding of the part forming a cap in the closed position of the cover. This is because, firstly, moulding in the closed position reduces the manufacturing costs of the closure: the mould used is of reduced dimensions, therefore less expensive; it is not necessary to provide an addition operation of closing the closing/opening part after the closure is removed from the mould in order to allow the storage and delivery thereof in the closed position, which avoids extending the cycle time and reducing the production rate. Moreover, moulding in the closed position makes it possible to fairly simply provide tamper-evident means between the ring and the cover by moulding these tamper-evident means in a single piece with the part forming a cap.

However, closures of this known type poses a certain number of problems. First of all, the known closures do not meet the increasing demand for asepticisation of the closures, by immersion in a bath of asepticising liquid or by spraying such a liquid.

This is illustrated by means of an example of a closure with a hinge of the prior art depicted in FIGS. 1 to 3, in the closed position, respectively in a side view, seen in the direction of the arrow A, and seen in axial section. The closure 100 comprises on the one hand a base part 101, intended to be mounted on the neck of a receptacle, and comprising a funnel 102 provided with a top opening. The closure 100 also comprises a closing/opening part 103 hinged on the base part 101 by a hinge 104, and able to be moved between a closed position in which the closing/opening part 103 covers the funnel 102 and closes off the top opening thereof, and an open position, in which the top opening of the funnel 102 is left clear. The hinge 104 has the general shape of a butterfly, comprising a top edge 105 in the form of an arc of a circle connected to the closing/opening part 103, a bottom edge 106 in the form of an arc of a circle connected to the base part 101, and two lateral edges 107*a*, 107*b*.

Asepticisation is carried by immersing the closure in a bath and/or by spraying an asepticising liquid, the closing/opening part being in the closed position. After this operation, it is necessary to rinse the closure in order to eliminate any trace of aseptic liquid. This operation is performed by spraying a rinsing liquid onto the closure. However, when the closing/opening part 103 is in the closed position, it exists a space e of very small dimensions between the hinge 104 and each of the two parts 101, 103 of the closure 100 (see FIG. 1). Because of this, it is not possible to rinse the closure 100 suitably, traces of aseptic liquid being liable to remain in the said space e, which is desirable.

In addition, the structure of this type of hinge—and in particular the small distance separating the top edge 105 from the bottom edge 106, does not make it possible to produce closures which, when the closing/opening part 103 is in the closed position, provides an excellent seal between the base part 101 and the closing/opening part 103. This is because, when the closing/opening part 103 is in the closed position, the bottom edge 108 of the closing/opening part 103 and the top edge 109 of the base part 101 are not perfectly contiguous, a clearance j existing between them (see FIGS. 1 to 3).

As a result, when the closure 100 is immersed in a bath for the asepticisation operation, the aseptic liquid can infiltrate through the space e and through the clearance j to the area between the external face of the funnel 102 and the internal face of the closing/opening part 103. However, this area cannot be suitably rinsed by spraying. This is all the more harmful since the consumer may drink the content of the receptacle provided with the closure directly through the funnel. Though this problem related to the asepticisation of closures has been illustrated with reference to a closure moulded in the open position, the same applies to the known closures moulded closed.

Moreover, the known closures do not give entire satisfaction with regard to tamper-evidence. This is because, usually, these closures comprise simple breakable bridges, broken into two parts when the cover is first opened. However, when the cover is closed again, the user does not see clearly whether the bridges have been broken, because of the small dimensions of these and the small distance separating the tamper-evident strip from the cover. In addition, the two parts of the bridge are placed exactly facing one another again.

Other tamper-evident means exist, but have other drawbacks. For example, when a completely detachable tamper-evident strip is provided, the user must take care of the removal of this tamper-evident strip. It is often thrown on the floor, but children may put it in their mouths; there is also a risk that the strip may be put back in the receptacle. The invention aims to mitigate these drawbacks.

To this end, and according to a first aspect, the invention concerns a closure of the aforementioned type, provided with tamper-evident means between the ring and the cover, in which the joining and hinging device is in the form of at least one strap, a first end of which is connected to the ring and a second end of which is connected to the cover, the arrangement of the strap, the base part and the part forming a cap being such that, when the base part and the part forming a cap are connected to one another, the cover being in the closed position, at least the sensitive zones of the closure are either situated in a sealed closed space or liable to be in contact with a liquid when the closure is immersed in said liquid or when said liquid is sprayed on the closure, and able then to be treated in order to remove the said liquid, so as to allow the asepticisation of the closure.

"Sensitive areas of the closure" means areas of the closure which are wanted to be free from contamination, in particular because a user is liable to place his mouth there, or because they may constitute a space for the proliferation of pathogenic germs which can be transferred to the content of the receptacle. The function of the particular structure of the closure according to the invention is thus to make the sensitive areas of the closure either enclosed in a impervious space or accessible to contact with an asepticising liquid, and to a rinsing liquid, for example sprayed. "Impervious" means impervious to liquids, when the closure is immersed in a liquid at a pressure less than 3 bar, or when a liquid is sprayed onto the closure. For example, the space between the external face of the cover and the opposite face of the strap is of sufficiently large size to be able to be treated in order to remove said liquid.

In addition, when the base part comprises an annular wall from which there project, substantially perpendicularly and in opposite directions, firstly an external skirt provided with an internal thread intended to cooperate with a complementary external thread on a receptacle neck, and secondly a funnel intended to be covered by the cover, the closure can be such that, when the cover is in the closed position, the cover and the funnel cooperate sealingly so that, in particular, the space between the funnel and the cover is closed and impervious. The tamper-evident means of a closure provided with such a strap can comprise an element connected on the one hand to the ring and on the other hand to the cover, said element being arranged so as to be deformed and broken when the cover is first opened, the element then being separated into a first part having a first end attached to the ring and a free second end and a second part having a first end attached to the cover and a free second end, the function of the arrangement of said element and said plug being to move the two free ends away from one another so that, when the cover is once again in the closed position, it exists between said two free ends a sufficiently great distance to be easily detected by a user.

The invention also concerns a closure comprising on the one hand a base part and on the other hand a part forming a cap itself comprising a ring and a cover associated by a joining and hinging device in which the tamper-evident means provided between the ring and the cover comprise at least one element connected on the one hand to the ring and on the other hand to the cover, said element being arranged so as to be deformed and broken when the cover is first opened, the element then being separated into a first part having a first end attached to the ring and a free second end and a second part having a first end attached to the cover and a free second end, the function of the arrangement of the said element and said plug being to move the two free ends away from one another so that, when the cover is once again in the closed position, it exists between said two free ends a sufficiently great distance to be easily detected by a user. For example the ring has, at a distance from the joining and hinging device, at least one recess formed from the top edge of the ring situated opposite the cover over a height less than the height of said ring, said recess having a width less than one third of the length of the circumference of the ring, the tamper-evident element being intended to be housed in said recess whilst being connected on the one hand at its bottom part to the bottom of the recess and on the other hand at its top part to the cover. Complementary mechanical means can be provided for forcing the deformation of the tamper-evident element when the cover is first opened or when the cover is closed following on from the first opening, so as to move away the free ends of the two parts of the broken tamper-evident element. The joining and hinging device of a closure provided with such tamper-evident means can be in the form of at least one strap, a first end of which is connected to the ring and a second end of which is connected to the cover, the arrangement of the strap, the base part and the part forming a cap being such that, when the base part and the part forming a cap are connected to one another, the cover being in the closed position, at least the sensitive zones of the closure are either situated in a sealed closed space or liable to be in contact with a liquid when the closure is immersed in said liquid or when the said liquid is sprayed on the closure, and able then to be treated in order to remove said liquid, so as to allow the asepticisation of the closure.

According to the second aspect, the invention concerns an assembly comprising a closure as previously described and a receptacle neck or a receptacle having a neck, said receptacle being empty or at least partially filled with a certain content. Finally, according to a third aspect, the invention relates to a method of producing such a closure which the annular ring, the cover, the strap and the tamper-evident means are moulded in a single piece and in the closed position.

BRIEF DESCRIPTION OF THE DRAWINGS

The other characteristics of the invention result from the following description of embodiments, a description given with reference to the accompanying figures, in which.

DETAILED DESCRIPTION

Figure 3:
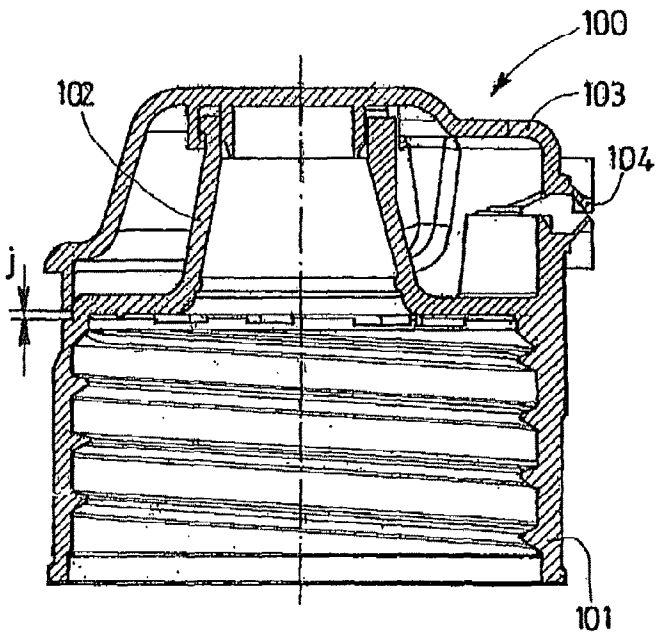
FIG.3 PRIOR ART
FIG. 3 is a view in axial section of a closure according to the invention.
Figure 1:
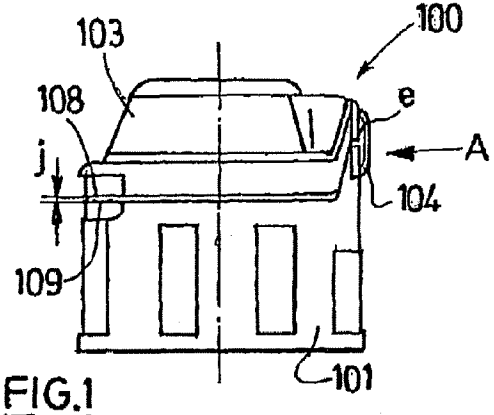
FIG.1 PRIOR ART
FIG. 1 is a side view of a closure according to the invention.
Figure 2:
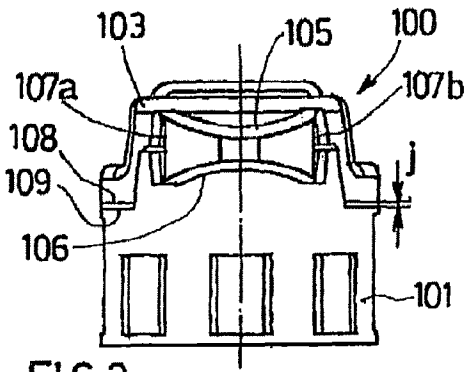
FIG.2 PRIOR ART
FIG. 2 is a side view of a closure according to the invention.
Figure 4:
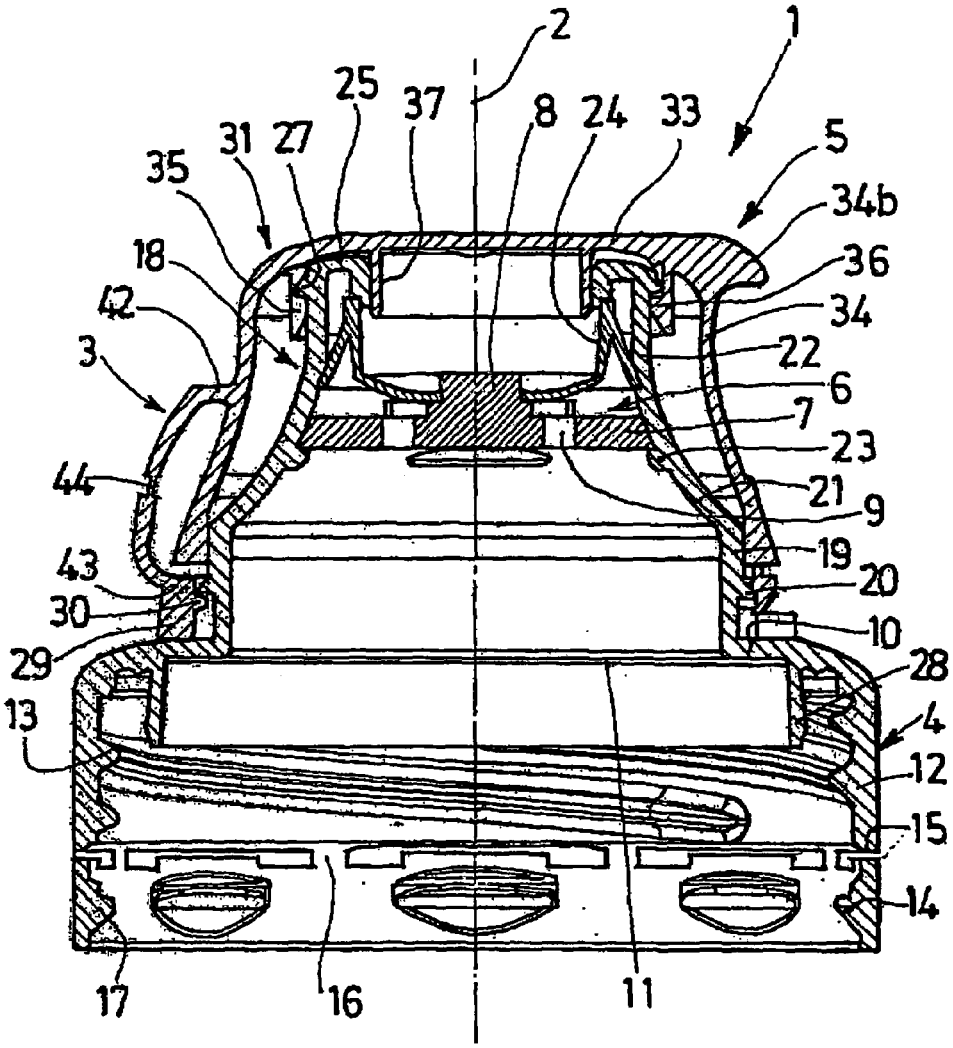
FIG. 4 is a view in axial section of a closure according to the invention, in the closed position.
Figure 5:
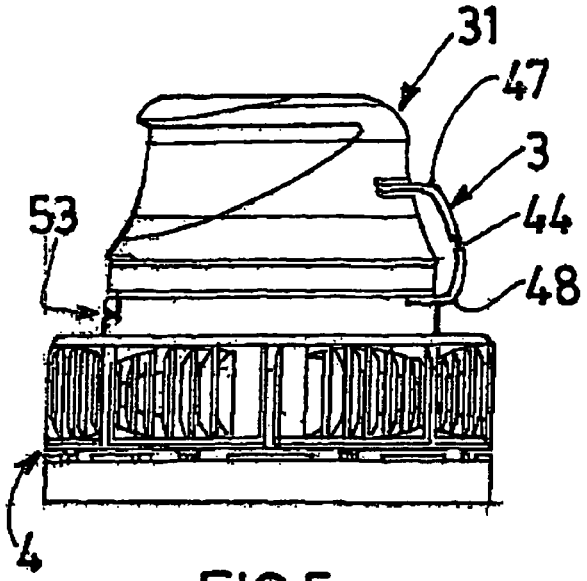
FIG. 5 is a side view of the closure, before the cover is first opened.
Figure 15:
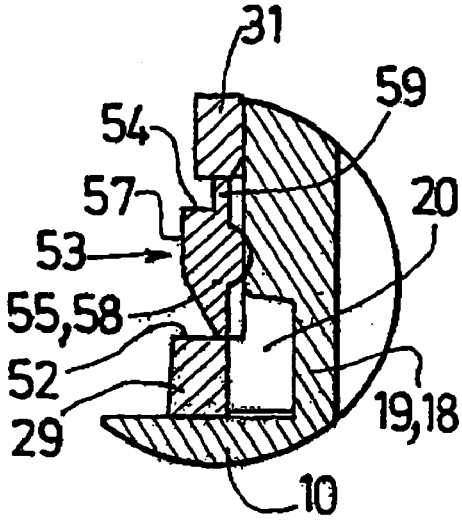
FIG. 15 is a partial view in axial section of the closure of FIG. 13, in the vicinity of the tamper-evident element, before the cover is first opened.
Figure 6:
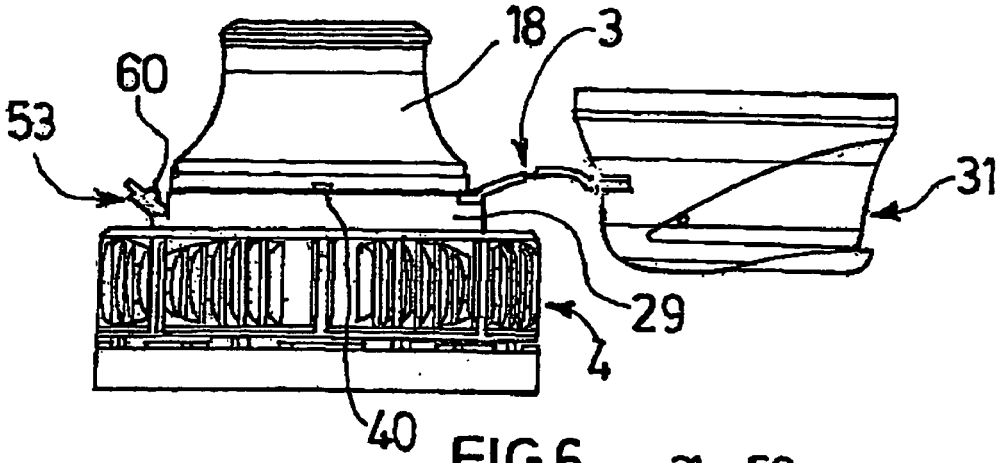
FIG. 6 is a side view of the closure, the cover being in the open position.

Reference is made first of all to FIGS. 4 to 6, which depict a closure 1 of axis 2, provided with a joining and hinging element 3. The closure 1 is for example produced from plastics material. The closure 1 comprises on the one hand a base part 4, intended to be mounted on a receptacle neck, and on the other hand a part forming a cap 5 intended to be associated with the base part 4. The closure 1 is described in a position where the axis 2 is vertical, the part forming a cap 5 being situated above the raised part 4. The axis 2 defines an elevation direction with respect to which the terms "height", "top", "bottom" are defined. A location close to the axis 2 is said to be "internal", in contradistinction to a location at a distance from the axis 2, said to be "external". Naturally, the closure 1 can take other positions in space, in particular when it is used by a consumer.

The neck with which the closure 1 is intended to be associated has an opening through which the content of the receptacle can pass. The neck comprises on its external face a thread, projections forming attachments means, situated under the thread, and a collar forming a support surface, situated under the projections. The receptacle can be flexible, so that a user, can, by pressing on the said receptacle, assist the discharge of the content. The receptacle can also be rigid.

The base part 4 of the closure 1 is described first of all. The base part 4, moulded in a single piece, is produced from a relatively rigid plastics material. The base part 4 comprises first of all an annular wall 10, of axis 2, having at its centre a pouring orifice 11 with a relatively large diameter, for example around three quarters of the outside diameter of the annular part 10.

The base part 4 also comprises a cylindrical external skirt 12, projecting substantially perpendicular to the annular wall 10 from the external edge thereof. The external skirt 12 is provided with an internal thread 13 able to cooperate with the external thread on the neck.

In addition, an annular tamper-evident strip 14 produced in a single piece with the base part 4, is connected to the free end 15 of the external skirt 12 by breakable bridges 16 or by a line of lesser strength. The tamper-evident strip 14 comprises attachment projections 17, directed towards the axis 2 of the closure 1, and intended to cooperate with the projections on the neck of the receptacle to enable the tamper-evident strip 14 to be held on the said neck.

The base part 4 also comprises a funnel 18, projecting substantially perpendicularly from the annular wall 10 from the internal edge thereof, around the pouring orifice 11, in the opposite direction to the external skirt 12. The funnel 18 comprises first of all a substantially cylindrical bottom portion 19, connected to the annular wall 10, and extending over approximately one third of the total height of the funnel 18. Approximately halfway up the bottom portion 19, the external face of the funnel 18 comprises a projection 20 the function of which will be described later.

The funnel 18 also comprises an intermediate portion 21 extending from the top edge of the bottom portion 19 towards to the top of the closure 1 and towards the axis 2. The intermediate portion 21 has substantially the form of a truncated cone the angle of which at the vertex is less than 90°, for example around 70°. Finally, the funnel 18 comprises a substantially cylindrical top portion 22, connected to the top edge of the second intermediate portion 22, extending over approximately one third of the total height of the funnel 18. The diameter of the top portion 22, which defines the top opening of the base part 4, is for example around one half the diameter of the bottom portion 19.

In the junction area between the top portion 22 and the intermediate portion 21, the funnel 18 can comprise an internal element 6 intended to regulate the discharge flow of the content of the receptacle. The element 6 comprises first of all a discoidal part 7 placed substantially perpendicular to the axes 2, held inside the funnel 18 by friction against the internal wall of the said funnel 18 and by contact with an internal rim 23 on the funnel 18. The discoidal part 7 is for example produced from polypropylene or high-density polyethylene. The discoidal part 7 has a central stud 8 directed towards the top portion 22 of the funnel 18, and at least one orifice 9, situated at a distance from the stud 8, and passing through said discoidal part 7 so as to make the inside of the receptacle provided with the closure 1 communicate with the top opening of the base part 4 of the closure 1.

The element 6 also comprises a flexible membrane 24, for example made from elastomer, situated in the immediate vicinity of the discoidal part 7, on the same side as the top portion 22 of the funnel 18. The flexible membrane 24 has a central opening able to cooperate with the stud 8 and also bears against the internal face of top portion 22 of the funnel 18.

This closure 1 is intended to be associated with a flexible receptacle. Under the effect of the pressure exerted by a user on the receptacle, the closure 1 being turned over so that the top opening of the base part 4 of the closure 1 is directed downwards, the flexible membrane 24 is deformed and its central opening is released from the stud 8. Thus the content of the receptacle can pass through the orifices 9 in the discoidal part 7 and the central opening in the flexible membrane 24. When no pressure is exerted on the receptacle, the membrane 24 is in the position depicted in FIG. 8, and the content of the receptacle cannot emerge towards the top opening of the base part 4 of the closure 1.

In addition, the funnel 18 comprises an external rim 27 towards to the top part of the top portion 22. The function of the external rim 27 is described later. Finally, the funnel 18 has, at its top end part, a fold 25. In addition, the base part 4 comprises an internal skirt 28 projecting substantially perpendicular from the annular wall 10 in the same direction as the external skirt 12. The internal skirt 28 is intended to cooperate with the internal face of the receptacle neck, for the purpose of impermeability.

The part forming the cap 5 of the closure 1 is now described. The part forming the cap 5 is moulded in a single piece and produced from a relatively rigid plastics material. The part forming a cap 5 comprises an annular ring 29 comprising at least one projection 30 on its internal face, said projection 30 being intended to cooperate with the projection 20 on the funnel 18. The ring 29 can have a continuous projection 30 or several projections 30 regularly spaced apart on its internal face. Thus the ring 29 is kept attached to the base part 4. In addition the bottom edge of the ring 29 is situated in the immediate vicinity of the annular wall 10 of the base part 4 of the closure 1.

The part forming a cap 5 also comprises a cover 31 connected to the ring 29 by a joining and hinging element in the form of a strap 3. The cover 31 is able to be moved between a closed position, in which the cover 31 covers the funnel 18, thus closing off the top opening of the base part 4 (FIGS. 4 and 5), and an open position, in which the funnel 18 is left clear, the said top opening not being closed off (FIG. 6).

The cover 31 comprises a top wall 33—able to cover the top opening of the base part 4—from which there project, substantially perpendicular and in the same direction:

an external lateral wall 34 able to surround the funnel 18 when the cover 31 is in the closed position, and comprising a front area 34*a*, substantially opposite to the hinge, surmounted by a rim 34*b*, arranged to allow easy opening of the cover 31 by simple action of the thumb;

an external skirt 35, situated inside the cover 31, provided with an internal rim 36 able to cooperate with the external rim 27 on the top portion 22 of the funnel 18, thus allowing closure by snapping the cover 31 onto the base part 4;

an internal skirt 37, with a smaller diameter than that of the external skirt 35, the said internal skirt 37 being able to cooperate with the fold 25, for the purpose of sealing.

The various sealing means provided on the one hand between the base part 4 and the neck (internal skirt 28 on the base part 4), and on the other between the base part 4 and the part forming a cap 5 (internal skirt 37), provide a perfect seal on the receptacle-closure 1 assembly with respect to the liquid contained in the receptacle, even if a user turns the receptacle over when the cover 31 is in the closed position. In addition, the lateral wall 34 has a height such that, when the cover 31 is the in the closed position, the free edge 38 of said lateral wall 34 is situated opposite the bottom portion 19 of the funnel 18, for example substantially halfway up said bottom portion 19. Thus the cover 31 and the funnel 18 cooperate sealingly on the one hand close to the free edge 38 of the lateral wall 34 of the cover 31, and on the other hand in the vicinity of the fold 25 of the funnel 18, via the internal skirt 37, so that the space between the external face of funnel 18 and the internal face of the cover 31 is closed and sealed, therefore not being able to be attacked by an asepticising liquid, neither from the inside nor from the outside of the closure.

Moreover, the height of the ring 29 is such that, when the cover 31 is in the closed position, the top edge 39 of said ring 29 is situated in the immediate vicinity of the free edge 38 of the cover 31, a very small and relatively invisible space existing between them. Before the cover 31 is first opened, the free edge 38 of the lateral wall 34 of the cover 31 can be connected to the top edge 39 of the ring 29, in particular by breaking bridges 40.

The strap 3 is now described. The strap 3 has a first end 43 connected to the ring 29 and a second end 42 connected to the cover 31. The strap 3 is for example connected to the ring 29 close to the top edge 39 of said ring 29, the second end 42 of the strap 3 being connected to the cover 31 at a significant distance from the ring 29, for example close to halfway up the height of the funnel 18. In addition, the distance between the external face of the cover 31 and the internal face of the strap 3—opposite the cover 31—is relatively great. Thus the space provided between the strap 3 and the cover 31 is relatively great, unlike the prior art, which helps to allow effective rinsing of the closure 1.

In the embodiments depicted, the strap 3 is substantially rectangular in shape and is vertically broad. The height of the strap 3 is for example between half and twice its length. The width of the strap 3 can be close to the diameter of the top portion 25 of the funnel 18.

The strap 3 is designed to allow moulding in the closed position of the part forming a cap 5 as well as excellent asepticisation of the closure 1. This is because the strap 3 is "external" to the closure 1 in that it does not require any particular arrangement of the closure 1 (strip 29 and cover 31) at the ends 42, 43 of the strap 3. In particular, no aperture is necessary on the ring or cover, and the strap 3 is not "integrated" in the ring or cover, but simply connected to these.

In addition, the material making up the strap 3 is sufficiently flexible to allow deformation of the said strap 3 in particular close to its ends 42, 43 (the strap 3 remaining however sufficiently strong). Thus, as illustrated in FIG. 6, the strap 3 enables the cover 31 to be opened between around 130° at a minimum and around 210° at a maximum, and enables the cover 31 to be held in the open position, without it being necessary to have recourse to a standard, more expensive, hinge, for example of the butterfly type. The hinge being produced by single element (the strap 3), the use of such a hinge is also simple and inexpensive.

The strap 3 comprises two transverse hinge areas 47, 48 each situated towards one end 42, 43 of the strap 3. Thus the strap 3 has, for example, when the cover 31 is in the closed position:

a first substantially horizontal part, connected to the external lateral wall 34 of the cover 31;

a second substantially vertical part;

a third substantially horizontal part, connected to the ring 29.

Figure 8:
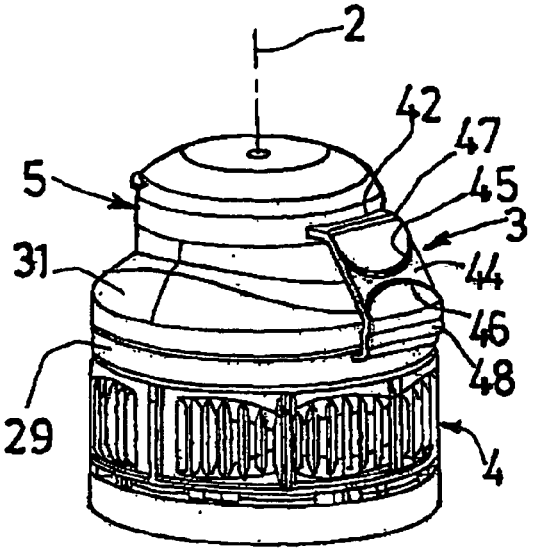
Figure 9:
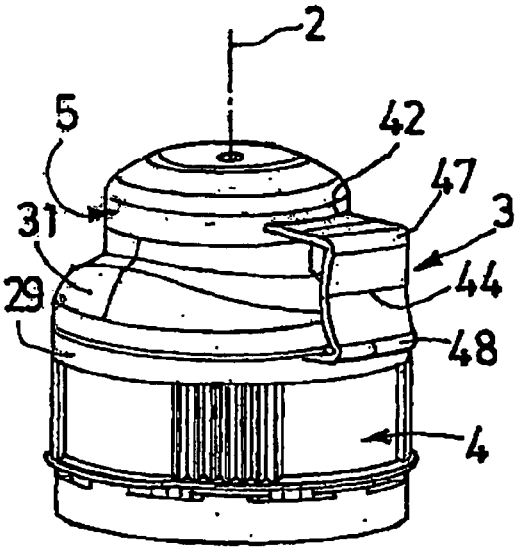
Figure 10:
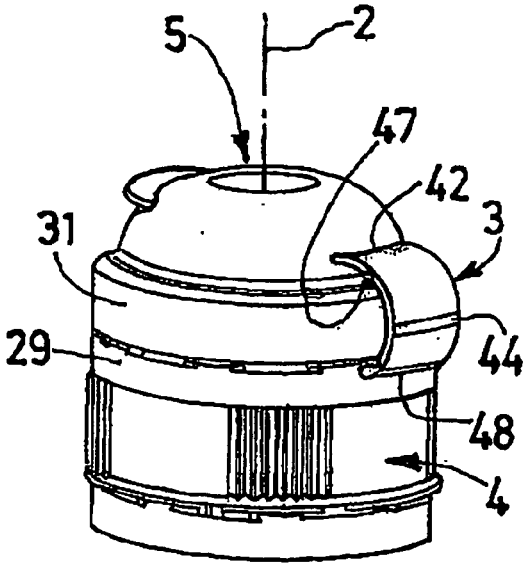
Figure 12:
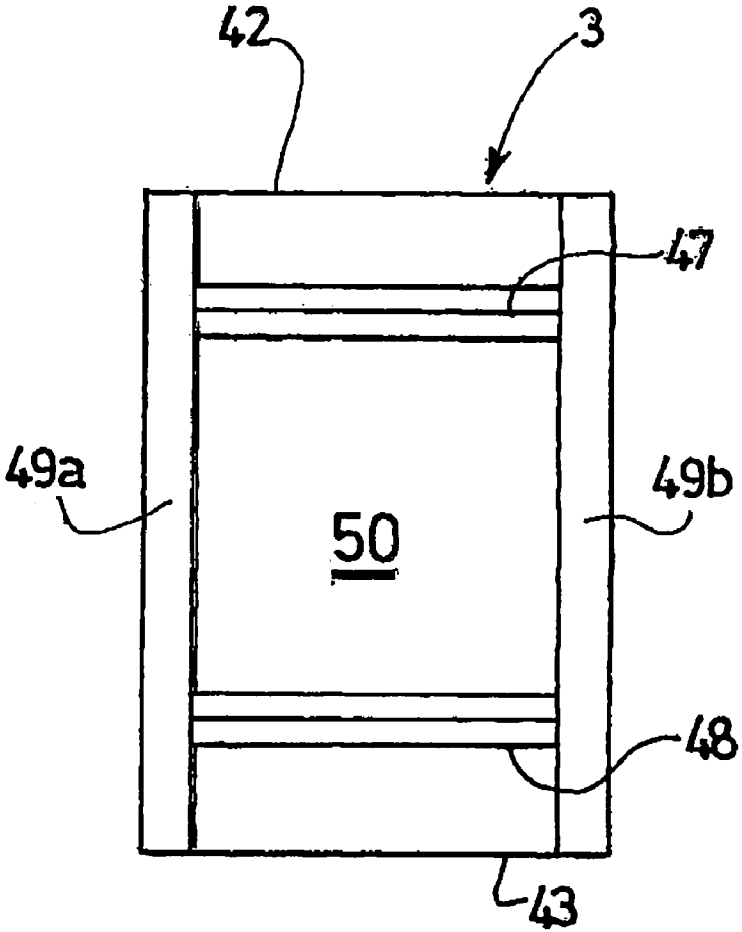
FIG. 12 is a schematic view of the internal face of the joining and hinging element in FIG. 10 disposed flat.
Figure 11:
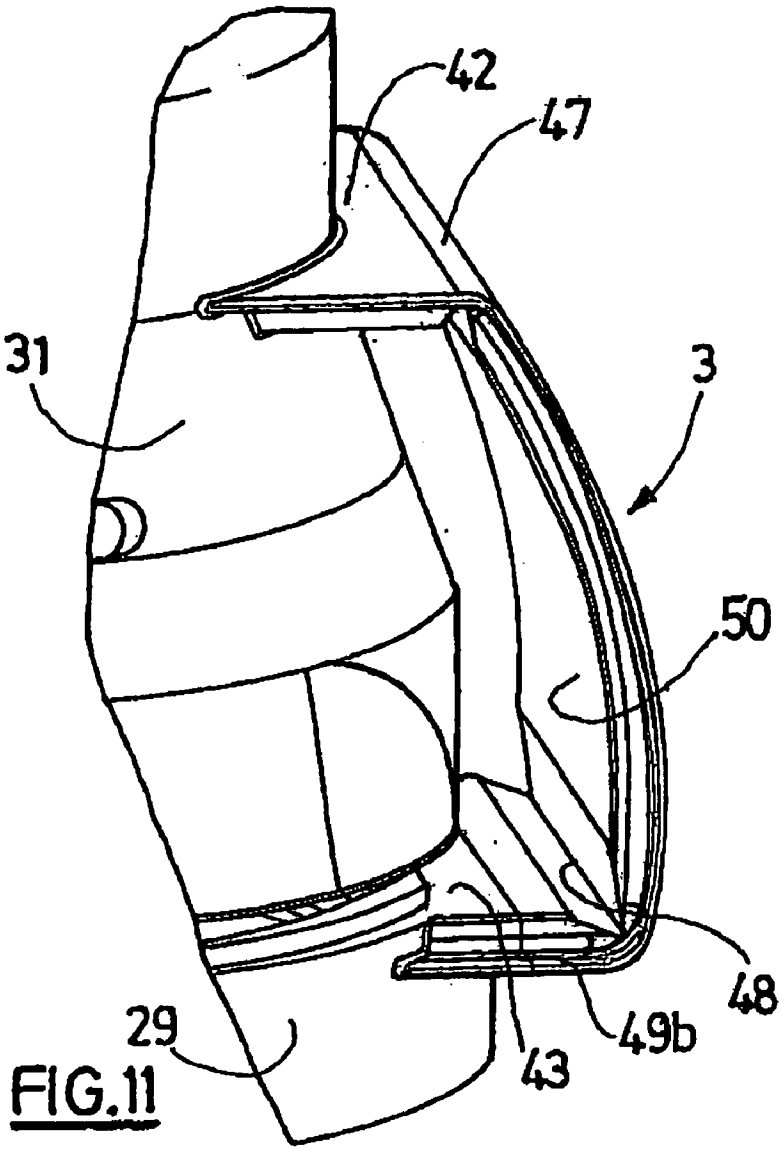
FIG. 11 is a partial view of a closure provided with a joining and hinging element according a fifth embodiment.

A hinge area 47, 48 may be a weakening line situated at a distance from the corresponding end 42, 43 of the strap 3 (FIG. 9 for example) or situated in the immediate vicinity of this end 42, 43 (FIG. 8 for example). This hinge area 47, 48 can be in the form of a localised thinning produced from the internal face of the strap 3. The hinge areas 47, 48 can also be obtained simply by the use of a relatively flexible material for producing the strap 3, to allow deformation of said strap in particular close to its ends.

According to one possible embodiment, the strap 3 also comprises at least one—and for example a single—transverse weakening area 44 situated between the two hinge areas 47, 48, for example substantially halfway up the strap 3. This transverse weakening area 44 can be in the form of a localised thinning. It is intended to assist the movement of the strap 3 towards the open position of the cover 31 and holding it in this position. According to other embodiments, the strap 3 has no such transverse weakening area 44.

Various embodiments of straps 3 are shown in FIGS. 7 to 12. According a first embodiment (FIG. 7, the base part 4 not being shown), the strap 3 has, in longitudinal section, the shape of a U the bottom of which is curved towards the outside of the closure 1, when the cover 31 is in the closed position. The weakening area 44 is delimited by two arcs of a circle 45, 46 the concavities of which are directed in opposite directions to one another, said weakening area 44 thus having substantially the shape of a butterfly, with a reduced thickness with respect to the rest of the strap 3. This thinning is here produced both from the internal and from the external face of the strap 3.

According to a second embodiment (FIG. 8), the strap 3 has, in longitudinal section, the shape of a U the bottom of which is directed aslant with respect to its arms, when the cover 31 is in the closed position. The weakening area 44 is here also delimited by two arcs of a circle 45, 46 forming a butterfly. According to a third embodiment (FIG. 9), the strap 3 has, in longitudinal section, the shape of a U the bottom of which is curved towards the closure 1, when the cover 31 is in the closed position. The weakening area 44 is substantially rectilinear. Finally, according to a fourth embodiment (FIG. 10), the strap 3 has a longitudinal section in the shape of an arc of circle when the cover 31 is in the closed position.

According to a fifth embodiment, the strap 3 is reinforced by the addition of two lateral walls 49*a*, 49*b*. The strap 3 thus has a central longitudinal part 50 of thickness $e_1$, comprising two transverse thinning areas 47, 48 each hinged towards one of the ends 42, 43 of the strap 3, and two lateral longitudinal parts 49*a*, 49*b*, situated on each side of the central longitudinal part 50. These lateral longitudinal parts 49*a*, 49*b* have a thickness $e_2$ less that the thickness $e_1$ of the central longitudinal part and have no transverse thinning area. The width of each of the lateral longitudinal parts 49*a*, 49*b* can be between 5% and 15% of the total width of the strap 3. By way of example, the thickness $e_1$ is around 0.7 mm, the thickness of the transverse thinning areas 47, 48 around 0.2 mm and the thickness $e_2$ greater than 0.2 mm. The width of each of the lateral longitudinal part 49*a*, 49*b* can be around 1 mm.

The existence of the lateral longitudinal part 49*a*, 49*b* with no transverse thinning areas makes it possible to avoid the creation of a rupture initiation liable to weaken the strap 3. Thus the minimum tensile strength of the strap 3 is 9 daN (as opposed to approximately 50 N for the straps in FIGS. 7 to 10), the rotational strength also being improved, since the strap 3 can be turned about its axis by 180° at a minimum without breaking. However, this structure makes it possible to keep an opening in the cover 31 between 130° and 180°, since the thinning areas 47, 48 are maintained.

The tamper-evident means according to the invention are described with reference to FIGS. 13 to 23. The ring 29 has, at a distance from the joining and hinging device 3, at least one recess 51, formed from the top edge 39 of the ring 29, over a height less than the height of said ring 29. The width of the recess 51 is less than one third of the length of the circumference of the ring 29. A tamper-evident element is intended to be housed in the recess 51 whilst being connected on the one hand at its bottom part to the bottom of the recess 51 and on the other hand at its top part to the cover 31.

The presence of this localised recess, at a distance from the strap 3, affords much better visibility of the tamper-evident element than in the closures of the prior art. The height of the ring 29 is such that, when the cover 31 is in the closed position, the top edge 39 of the said ring 29 is situated in the immediate vicinity of the free edge 38 of the cover 31, the height of the tamper-evident element being substantially equal to the height of the recess 51. In addition, the particular deformation of the various tamper-evident elements according to the invention enables a user to see easily, or even immediately, whether the closure has already been opened.

Reference is made first of all to FIGS. 13 to 17, which show a first embodiment of the tamper-evident element. The recess 51 is substantially rectangular, with a height for example close to the three quarters of the height of the ring 29, and comprises a bottom 52 substantially parallel to the top edge 39 of the ring 29. The recess 51 is preferably diametrically opposed to the strap 3, for better visibility of the tamper-evident means. The element forming a tamper-evident telltale 53 is housed in the scollop 51. The tamper-evident element 53 has the general shape of a substantially flat half disc delimited by a rectilinear top edge 54 and by a bottom edge 55 in the form of a semicircle, and having an internal face 56 and an external face 57. Naturally the closure 1 according to the invention can comprise several recesses 51 each associated with a tamper-evident element 53.

The bottom edge 55 of the tamper-evident element 53 is connected to the bottom 52 of the recess 51 by a sufficiently flexible connection to allow the pivoting of said tamper-evident element 53 about the bottom 52 of the recess 51. To this end, the external face 57 of tamper-evident element 53 has, towards the bottom edge 55, a thinning 58, for example produced from the external face of the tamper-evident element 53, the connecting area between the tamper-evident element 53 and the ring 29 being thereby reduced compared with the total thickness of the ring 29. The height of the tamper-evident element 53 is substantially equal to the height of the recess 51, so that, before the cover 31 is first opened, the top edge 54 of the tamper-evident element 53 is situated so as to be continuous with the top edge 39 of the ring 29. Before the cover 31 is first opened, the top edge 54 of the tamper-evident element 53 is connected to the free edge 38 of the lateral wall 34 of the cover 31 by a breakable bridge 59.

In addition, the tamper-evident element 53 comprises a protrusion 60 on its internal face 56, said protrusion 60 being compact with the external face of the bottom portion 19 of funnel 18 before the cover 31 is first opened. The dimensions of the protrusion 60 and the relative positioning of the funnel 18 and tamper-evident element 53 are chosen so that, before the cover 31 is first opened, the tamper-evident element 53 is forced towards the outside of the closure 1, by pressure of the protrusion 60 against the funnel 18. For this purpose, firstly, the breakable bridge 59 and the connection between the tamper-evident element 53 and the bottom 52 of the recess 51 are sufficiently strong to enable the tamper-evident element 53 to be held in this position, although the tamper-evident element 53 is subjected on the part of the funnel 18 to a force directed towards the outside. Secondly, the material making up the base part 4 of the closure 1 and the material making up the part forming a cap 5 must be sufficiently rigid for neither the protrusion 60 nor the area of the funnel 18 situated opposite the protrusion 60 to be deformed significantly, and for the contact between the protrusion 60 and the funnel 18 to generate a thrust force towards the outside of the closure 1.

The way in which the tamper-evident element 53 enables a consumer to check visibly and unambiguously that the cover 31 has not been opened is now described. Before the cover 31 is first opened (FIGS. 5, 13 and 15), the tamper-evident element 53 is connected to the free edge 38 of the side wall 34 of the cover 31 by the intact breakable bridge 59. In addition, the protrusion 60 is in contact with the funnel 18, the tamper-evident element 53 being forced towards the outside of the closure 1.

When the cover 31 is first opened, the user acts on the cover 31, pulling it and moving it, via the strap 3, to the open position. The breakable bridges 40 connecting the free edge 38 of the lateral wall 34 of the cover 31 to the top edge 39 of the ring 29, on one hand, and the breakable bridge 59 connecting the tamper-evident element 53 to the free edge 38 of the lateral wall 34 of the cover 31, on the other hand, are broken.

Figure 16:
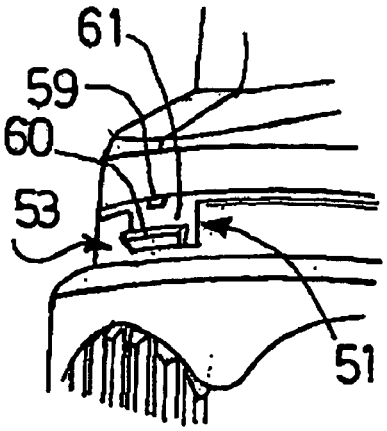
FIG. 16 is a partial perspective view of the closure of FIG. 13, in the vicinity of the tamper-evident element, after the cover is first opened, the cover being in the closed position and the tamper-evident element released.
Figure 17:
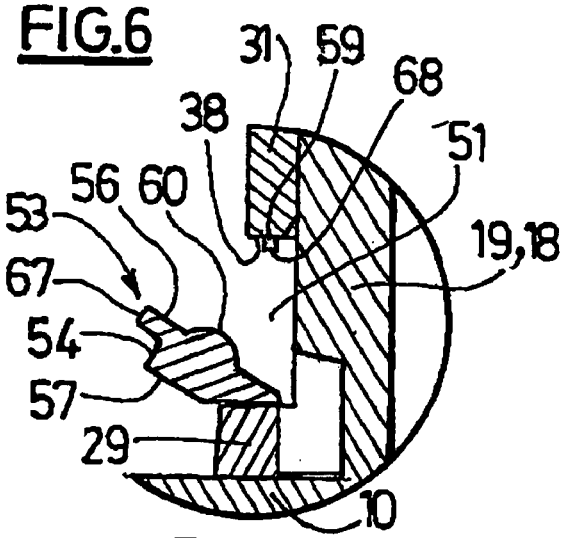
FIG. 17 is a partial view in axial section of the closure of FIG. 13, in the vicinity of a tamper-evident element after the cover is first opened, the cover being in the closed position.
Figure 7:
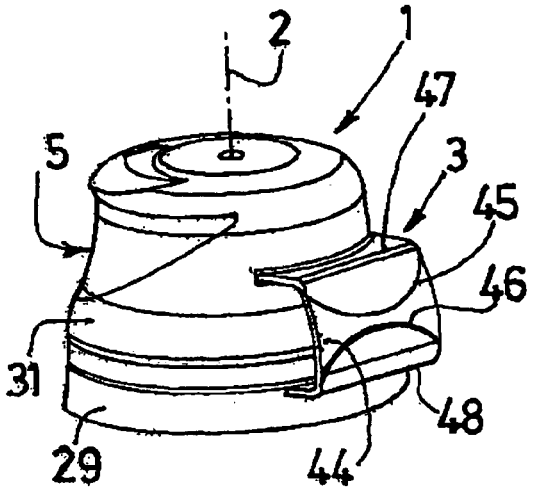
FIGS. 7 to 10 are views in rear perspective of closures according to the invention, provided with a joining and hinging element according to respectively first, second, third and fourth embodiments.

The tamper-evident element 53 is then no longer connected to the cover 31. Because of the forcing of the tamper-evident element 53 towards the outside, via the protrusion 60 cooperating with the funnel 18, and the flexible connection between the bottom edge 55 of the tamper-evident element 53 and the bottom 52 of the recess 51, the tamper-evident element 53 is pushed towards the outside of the closure 1 and pivots about said flexible connection. When the cover 31 is once again in the closed position, the tamper-evident element 53 keeps this position (FIGS. 16 and 17).

The tamper-evident element 53 is then situated in a position such that the thinning 58 is substantially in contact with the bottom 52 of the recess 51, of the protrusion 60 no longer being in contact with the funnel 18. Thus the fact that the cover 31 has already been opened is perfectly visible, since the free ends 67, 68 of the two parts of the tamper-evident element 53 formed by the breaking of the bridge 59 are distant from one another significantly, following on from the pivoting of said tamper-evident element 53.

When the closure 1 is looked at sideways (FIGS. 6 and 17), it can be seen clearly that the tamper-evident element 53 is projecting towards the outside of the closure, rather than housed in the recess 51, in contact with the funnel 18. In addition, when the closure 1 is looked at "front on", that is to say in the direction of the tamper-evident element 53, a space 61 appears between the free edge 38 of the lateral wall 34 of the cover 31 and the top edge 54 of the tamper-evident element 53 (FIG. 16). Because of the pivoting of the tamper-evident element 53 about the bottom 52 of the recess 51, this space 61 is relatively large, and in any event with dimensions greater than the space generally existing between a tamper-evident strip and a cover. By way of comparison, the breakage of the bridges 40 between the ring 29 and the cover 31 is not as clearly visible.

Figure 14:
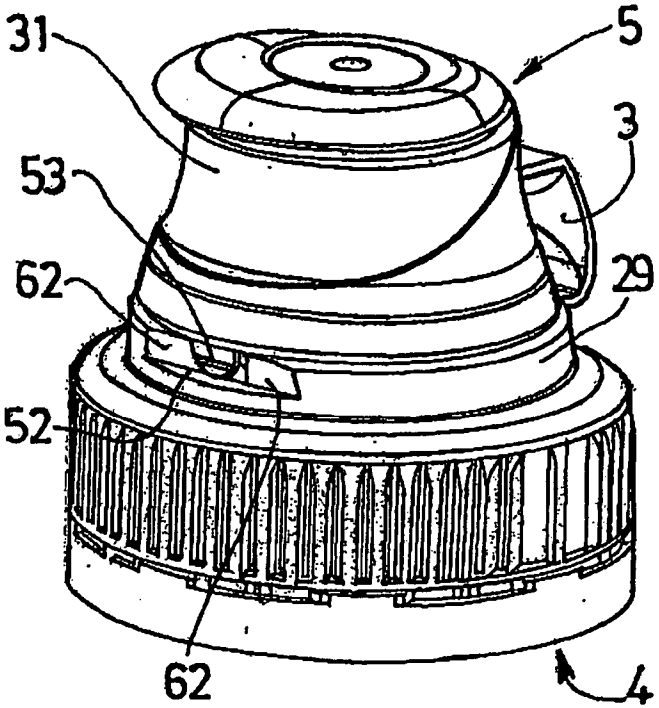
FIG. 14 is a perspective view of a closure according to the invention, the closure comprising a tamper-evident element according to a second embodiment, before the cover is first opened.
Figure 13:
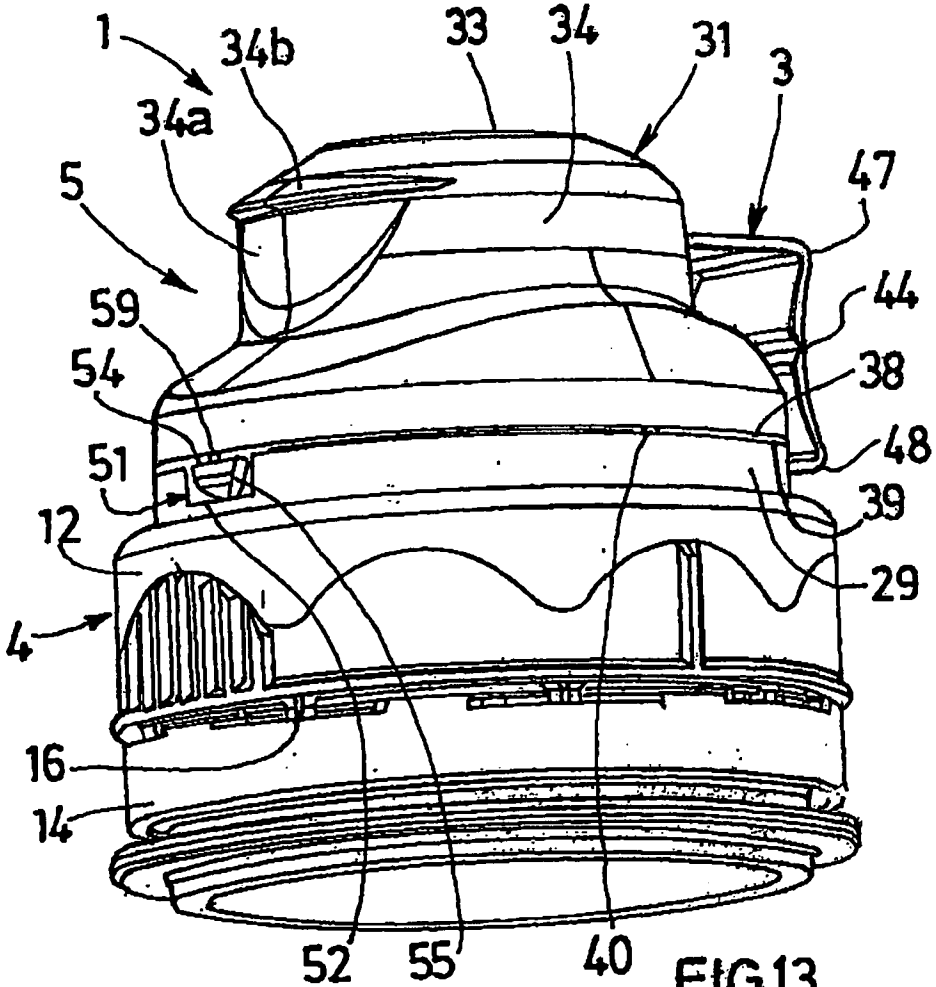
FIG. 13 is a perspective view of a closure according to the invention screwed onto a receptacle neck, before the cover is first opened, the closure comprising a tamper-evident element according a first embodiment.

In the variant illustrated in FIG. 14, the recess 51 is also substantially rectangular and comprises a bottom 52, as well as two lateral walls 62. The lateral walls 62 of the recess 51 extend aslant from the external face of the ring 29 towards the internal face of said ring 29 and towards the tamper-evident element 53. The structure on the one hand leaves clear the recess 51 for better visibility of the tamper-evident element 53, and on the other hand facilitates the removal of the part forming a cap 5 from the mould, not creating any undercuts.

Figure 18:
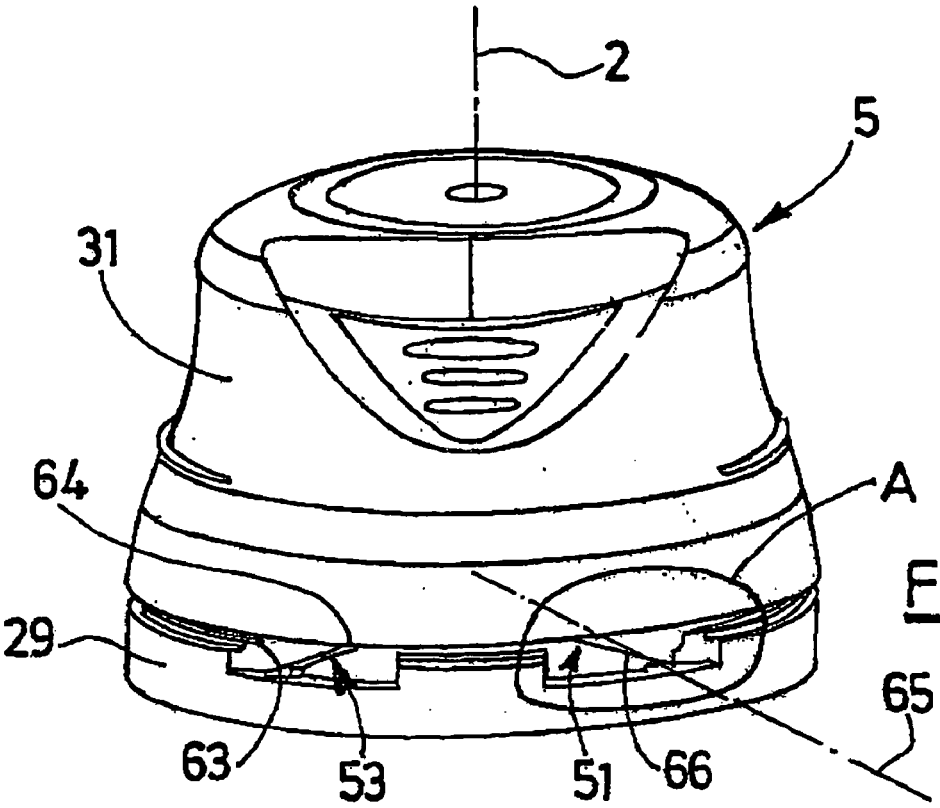
FIG. 18 is a perspective front view of part of a closure according to the invention, after the cover is first opened, the closure a comprising a plurality of tamper-evident elements according to a second embodiment.
Figure 19:
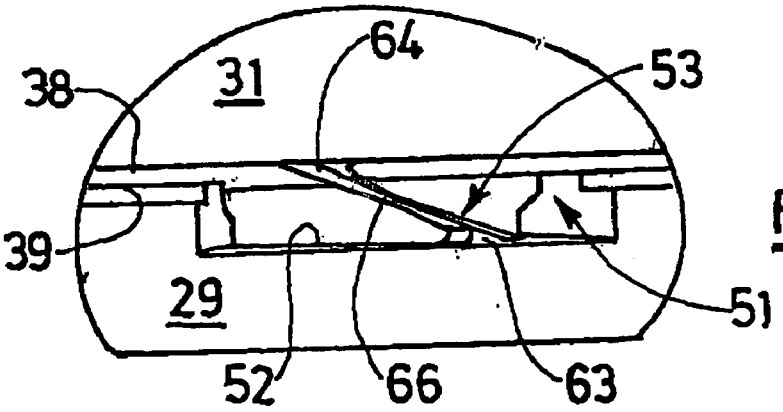
FIG. 19 is an enlarged view of detail A in FIG. 18.
Figure 20:
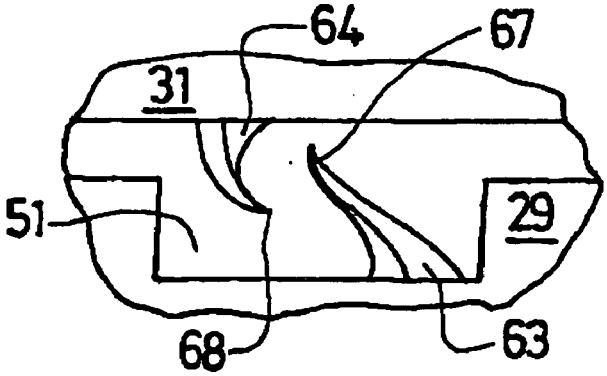
FIG. 20 is an enlarged view of detail A in FIG. 18, after the cover is first opened, the cover being in the closed position.

Reference is now made to FIGS. 18 to 20, which depict a second embodiment of the tamper-evident element. The tamper-evident element 53 is in the form of a rod whose end 63 fixed to the ring 29 and end 64 fixed to the cover 31 are offset with respect to one another along the circumference of the closure 1. Thus the overall axis 65 of the rod is inclined with respect to the axis 2 of the closure 1. The axis 65 of the rod is for example inclined by an angle of between 30° and 60° with respect to the axis 2 of the closure 1.

The rod is housed in a recess 51, the end 63 of said rod being connected to the bottom 52 of the recess 51. The distance between the ends 63, 64 of the rod is less than the width of the recess 51. The rod has a substantially polygonal cross section but could also have a circular cross section. The cross section of the rod is smaller at its substantially middle part 66 than at its ends 63, 64.

When a user opens the cover 31, thereby moving away the two ends 63, 64 of the rod, the rod extends and its axis 65 tends to be oriented parallel to the axis 2 of the closure 1. Locally, at the ends 63, 64, the rod pivots. At a certain angle of opening of the cover 31, the strength limit of the rod is reached. The rod is then broken, at its smallest cross section, that is to say substantially at its middle.

However, the rod keeps the deformation resulting from the opening movement of the cover 31, particularly at its ends 63, 64, where the two parts resulting from the breakage of the rod are locally substantially parallel to the axis 2 of the closure 1. As a result the two free ends 67, 68 of the two parts of the rod are separated from one another. Such would not have been the case with a conventional bridge, oriented parallel to the axis 2 of the closure 1: such a bridge would have been deformed parallel to the axis 2, and the two free ends resulting from the breakage of this bridge would thereby have been situated opposite one another, substantially in contact, after the closure of the cover 31. Here, on the other hand, the pivoting of the rod at its ends 63, 64 has caused the non-alignment of the two parts of the rod and the moving away of the two free ends 67, 68. This embodiment also has the following advantages: removal from the mould by slides in the mould, not requiring any external reworking; flexibility of the rods when the part forming a cap 5 is assembled on the base part 4, thereby preventing the deformation or any breakage of the rods.

The closure 1 can comprise several recesses 51 each provided with a tamper-evident element 53 in the form of a rod. For example, unlike the strap 3, two rods are provided. These rods are situated at a distance from one another and inclined symmetrically (FIG. 18). The closure 1 can also comprise four recesses 51 regularly distributed at the periphery.

Figure 21:
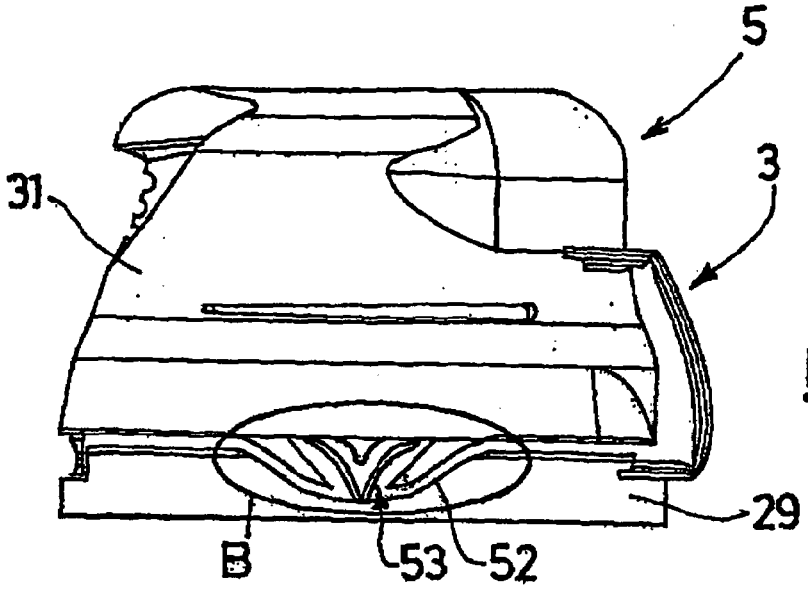
FIG. 21 is a side view of part of a closure, before the cover is first opened, the closure comprising a tamper-evident element according to a third embodiment.
Figure 22:
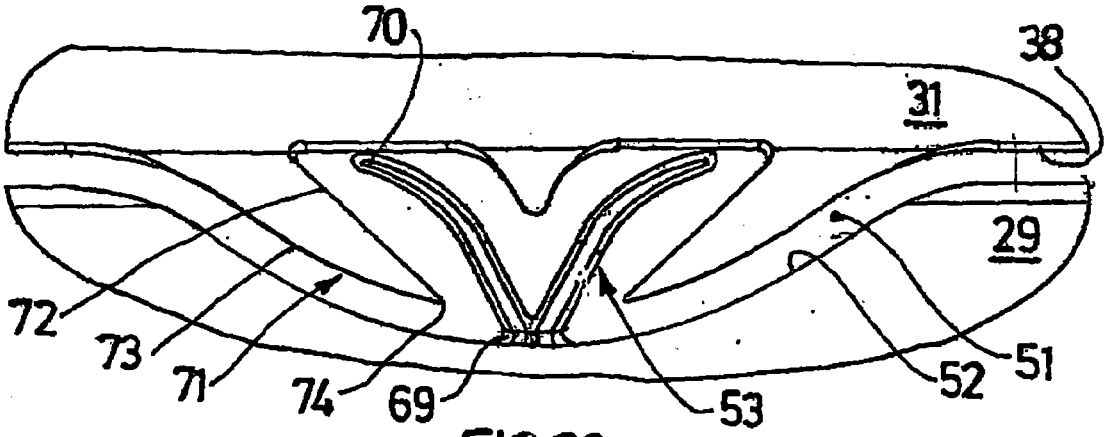
FIG. 22 is an enlarged view of detail B in FIG. 21.
Figure 23:
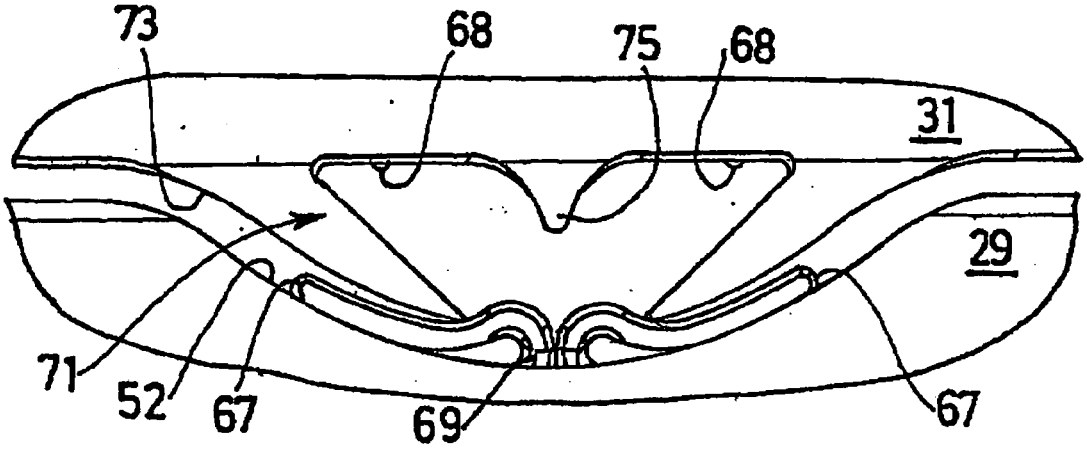
FIG. 23 is an enlarged view of detail B in FIG. 21, after the cover is first opened, the cover being in the closed position.

Finally, reference is made to FIGS. 21 to 23, which depict a third embodiment of the tamper-evident element. The closure 1 comprises here two recesses 51 the bottom 52 of which has a rounded shape, each recess 51 being provided with a tamper-evident element 53. The recesses 51 are each situated at 90° from the strap 3. The tamper-evident element 53 is in the form of a rod the end 69 of which is fixed to the ring 29, at the bottom 52 of the recess 51, and the end 70 of which is fixed to the cover 31, are offset with respect to one another along the circumference of the closure 1. Thus the overall axis of the rod is inclined with respect of the axis 2 of the closure 1.

For example, the rod has a first substantially linear area, extending from its end 69, fixed to the ring 29 over at least two thirds of the height of the recess 51. This first area is inclined with respect to the axis 2 of the closure 1 by an angle of between 20° and 50°. The first area is extended by a second slightly curved area, and inclined overall by angle of between 50° and 70°, extending towards and as far as the end 70 of the rod fixed to the cover 31.

The rod has for example a circular cross section, and this cross section is smaller in the vicinity of its end 70 connected to the cover 31. In addition, the cover 31 has an appendage 71 extending towards the ring 29. The appendage 71 is directed aslant, substantially parallel to the overall axis of the rod. The appendage 71 has for example the shape of a triangle whose base is substantially merged with the free edge 38 of the lateral wall 34 of the cover 31, the side 72 of which facing the rod is substantially parallel to the rod, and the side 73 of which opposite to the side 72 has a curved shape complementary to the shape of the bottom 52 of the recess 51. The tip 74 of the appendage 71 is situated in the vicinity of but at a distance from the end 69 of the rod fixed to the ring 29.

The first opening of the cover 31 results in the rupture of the rod, at its end 70 connected to the cover (the area with the smallest cross section). When the cover 31 is closed again, the appendage 71 comes into contact with the broken rod, and moves it in order to bend it towards the ring 29. When the cover 31 is in the closed position, the rod is retained between the bottom 52 of the recess 51 and the side 73 of the facing triangle. Because of this, the free ends 67, 68 of the two parts of the rod are formed following the rupture of the rod are distant from each other, the space between them being sufficiently great to be able to be easily detected by a user.

According to one possible embodiment, the closure 1 comprises two rods the ends 70 of which close to the smallest cross section of the rod are situated at a distance from one another and the other ends 69 of which are substantially adjacent. These rods are inclined substantially symmetrically, so as to form a V, as depicted in FIG. 22. The closure 1 comprises two appendages 71 situated outside the V.

In addition, a projecting area of material 75 is provided on the free edge 38 of the cover 31 in order to extend, between the two rods, towards the ring 29. This area 25 serves in particular as a means of reinforcing the closure 1. Naturally, the tamper-evident element 53 can be reversed, the smallest cross section of the rod being able to be close to its end connected to the ring, and the appendage extending from the ring towards the cover. After the first opening of the cover, the rod is bent towards said cover.

In addition, the very great visibility of the loss of tamper-proofness conferred by the invention can be greatly increased if the base part 4 and part forming a cap 5 of the closure 1 are produced in different colours. This can achieved very simply since the two parts of the closure 1 are moulded separately.

Thus the space 61 is the same colour as the base part 4 and stands out clearly from the cover 31 and the ring 29, both in the same colour different from the colour of the base part 4. In addition to the many aesthetic possibilities, the production of a closure 1 in two colours affords better visibility of the tamper-evident means, and this in an immediate way.

The invention has other advantages. In particular, the cover 31 is captive, since it is associated with the base part 4 of the closure 1 via the strap 3 and the ring 29. The tamper-evident element 53 is also captive, since it remains connected to the ring 29. This presents in particular additional safety vis-à-vis children, who cannot raise said tamper-evident element 53 to their mouths. Naturally, the various embodiment described can be combined with each other, the invention not being limited to the particular configurations depicted in the drawings.

The invention claimed is:

1. A closure of the type comprising:

a first piece defining a base part comprising a top opening; opening at opposite axial ends, and intended to be mounted on the neck of a threaded receptacle, wherein said base bottom opening is defined by an annular wall from which an external skirt substantially perpendicularly projects and cooperates with the thread on the receptacle neck and the base top opening is defined by a funnel; and a second piece defining an annular ring connected to the base part and a cover associated with the annular ring by a joining and hinging device, wherein the cover is able to be moved with respect to the annular ring between an open position and a closed position, wherein when the cover is located over the funnel of the base in the closed position, the cover and the funnel cooperate to provide a closed and impermeable space therebetween;

wherein the joining and hinging device is in the form of at least one strap which includes a first end connected to the annular ring and a second end connected to the cover;

tamper-evident means between the annular ring and the cover, the tamper-evident means comprising an element connected on the one hand to the ring and on the other hand to the cover, said element being arranged so as to be deformed and broken when the cover is first opened, the element then being separated into a first part having a first end attached to the ring and a free second end and a second part having a first end attached to the cover and a free second end, the function of the arrangement of said element and said plug being to move the two free ends away from one another so that, when the cover is once again in the closed position, there exists between said two free ends a sufficiently great distance to be easily detected by a user;

wherein the arrangement of the strap, the base part and the part forming the cover are connected to one another and the cover is in the closed position, the space between the external face of the cover and the opposite face of the strap is of sufficiently large dimension to facilitate removal of liquid in which the closure has been immersed or which has been sprayed on the closure.

2. A closure according to claim 1 wherein the height of the strap is between 0.5 and 2 times the width of the strap.

3. A closure according to claim 1 wherein the strap comprises two transverse hinge areas each situated towards one of the ends of the strap.

4. A closure according to claim 3 wherein at least one of the hinge areas is situated in the immediate vicinity of one end of the strap.

5. A closure according to claim 3 wherein the hinge areas are in the form of a localised thinning produced from the internal face of the strap.

6. A closure according to claim 1 wherein when the cover is in the closed position, the strap has in longitudinal section the shape of a U the bottom of which is directed aslant with respect to its arms.

7. A closure according to claim 3 wherein the strap also comprises at least one transverse weakening area situated between the two hinge areas.

8. A closure according to claim 7 wherein the transverse weakening area is in the form of a localised thinning.

9. A closure according to claim 7 wherein the weakening area is substantially rectilinear.

10. A closure according to claim 1 further comprising a weakening area of the strap which is delimited by two arcs of a circle, the concavities of which are directed in opposite directions to one another, said weakening area having substantially the shape of a butterfly.

11. A closure according to claim 1 wherein the material constituting the strap is sufficiently flexible to allow a deformation of said strap in particular in the vicinity of its ends.

12. A closure according to claim 1 wherein the opening of the cover is comprised between around 130° at a minimum and around 210° at a maximum.

13. A closure according to claim 1 wherein the cover comprises a second internal skirt able to cooperate with the internal face of the funnel.

14. A closure according to claim 1 wherein the annular ring comprises attachment means able to cooperate with complementary attachment means on the base part and in that the cover comprises snapping-on means able to cooperate with reciprocal snapping-on means on the base part of the closure.

15. A closure according to claim 1 wherein the height of the ring is such that, when the cover is in the closed position, the top edge of said ring is situated in the immediate vicinity of the free edge of the cover.

16. A two-piece container closure apparatus comprising:

a first piece defining a base including a liquid passageway with an opening; and a second piece defining a cover being rotatable from an open position allowing user access to the passageway opening, to a closed position blocking user access to the passageway opening, and the second piece further defining a ring which attaches to the base;

a hinge coupling the cover to the ring and spanning from an upper region of the cover to a lower region of the ring;

the hinge, cover and ring being a single piece and being concentrically aligned along a longitudinal axis; and a tamper-evident member located between the ring and the cover which projects outwardly from the ring and which is released from the cover by rotational opening of the cover about the hinge which substantially creates a predominantly linear severing force to the member which causes the tamper-evident member to project radially outwardly from the ring with respect to the longitudinal axis, the member being retained at its non-severed portion attached to one of the ring and the cover, wherein a middle of the hinge is spaced outwardly away from and exterior of the cover.

17. The apparatus of claim 16 wherein the tamper-evident member is a frangible and diagonally elongated structure.

18. The apparatus of claim 16 wherein the tamper-evident member includes a first thinned end directly attached to the ring, a second thinned end directly attached to the cover, and a laterally enlarged middle.

19. The apparatus of claim 16 wherein the cover is a flip-top which is retained to the base when in its open position.

20. The apparatus of claim 16 wherein the hinge includes at least one thinned segment.

21. The apparatus of claim 16 wherein the configuration of the base, cover, ring and hinge allow for complete asepticisation and rinsing of all sensitive areas of the cover and base which are not in a sealed or closed space.

22. The apparatus of claim 16 wherein the hinge includes an arcuate formation lateral to the elongated dimension of the hinge.

23. The apparatus of claim 16 wherein the cover includes a user engagable overhang, located opposite the hinge.

24. The apparatus of claim 16 further compiling a container ached to the base.

* * * * *